US010526171B2

(12) United States Patent
Steiner et al.

(10) Patent No.: US 10,526,171 B2
(45) Date of Patent: Jan. 7, 2020

(54) SUPPORT UNIT FOR ELEVATOR INSTALLATION

(71) Applicant: Inventio AG, Hergiswil (CH)

(72) Inventors: Adrian Steiner, Inwil (CH); Marcel Nicole, Stansstad (CH)

(73) Assignee: INVENTIO AG, Hergiswil NW (CH)

( * ) Notice: Subject to any disclaimer, the term of this patent is extended or adjusted under 35 U.S.C. 154(b) by 265 days.

(21) Appl. No.: 15/567,110

(22) PCT Filed: Apr. 18, 2016

(86) PCT No.: PCT/EP2016/058506
§ 371 (c)(1),
(2) Date: Oct. 17, 2017

(87) PCT Pub. No.: WO2016/169877
PCT Pub. Date: Oct. 27, 2016

(65) Prior Publication Data

US 2018/0086602 A1 Mar. 29, 2018

(30) Foreign Application Priority Data

Apr. 20, 2015 (EP) ..... 15164278

(51) Int. Cl.
*B66B 11/02* (2006.01)
*B66B 17/12* (2006.01)

(52) U.S. Cl.
CPC ..... *B66B 11/0206* (2013.01); *B66B 17/12* (2013.01)

(58) Field of Classification Search
CPC ..... B66B 11/0206; B66B 17/12
See application file for complete search history.

(56) References Cited

U.S. PATENT DOCUMENTS 2,142,063 A * 12/1938 Tompkins ..... A63J 1/00 472/78
3,519,101 A * 7/1970 Sieffert ..... B66B 9/187 187/256
5,435,417 A * 7/1995 Hakala ..... B66B 11/0055 187/266
5,566,785 A * 10/1996 Hakala ..... B66B 11/0055 187/250

(Continued)

FOREIGN PATENT DOCUMENTS

CN 103787169 A 5/2014
CN 203682813 U 7/2014
WO 2011012504 A1 2/2011

*Primary Examiner* — Michael A Riegelman
(74) *Attorney, Agent, or Firm* — William J. Clemens; Shumaker, Loop & Kendrick, LLP

(57) ABSTRACT

A support unit for the fastening of a diverting roller to a support structure can be used for supporting a car in an elevator installation. The support unit has two yoke beams and a bearing for the diverting roller. The yoke beams are arranged parallel to one another for fastening to the support structure. On the support unit there are at least two restraint devices that are fastened to the yoke beams and which project into the intermediate space between the yoke beams such that, in the event of failure of the bearing, the restraint devices form a stop to prevent the diverting roller from moving in a support direction under the action of the support force. The support unit is stable, is of simple construction and is of space-saving design.

9 Claims, 5 Drawing Sheets

(56) References Cited

U.S. PATENT DOCUMENTS

| | | | | |
|---|---|---|---|---|
| 5,573,084 | A * | 11/1996 | Hakala | B66B 11/0055 187/252 |
| 7,665,580 | B2 * | 2/2010 | Stocker | B66B 7/10 187/266 |
| 2008/0289908 | A1 * | 11/2008 | Murao | B66B 11/0206 187/266 |
| 2009/0071758 | A1 * | 3/2009 | Yu | B66B 11/0206 187/254 |
| 2010/0258699 | A1 | 10/2010 | Boychuk et al. | |
| 2011/0056770 | A1 * | 3/2011 | Qiu | B66B 11/02 187/266 |
| 2011/0061978 | A1 * | 3/2011 | Dominguez | B66B 11/0206 187/401 |
| 2012/0160615 | A1 * | 6/2012 | Girgis | B66B 19/007 187/411 |
| 2016/0159615 | A1 * | 6/2016 | Maruyama | B66B 11/0206 187/266 |

* cited by examiner

SUPPORT UNIT FOR ELEVATOR INSTALLATION

FIELD OF THE INVENTION

The present invention relates to a support unit for an elevator installation. The support unit is used to fasten a deflection roller to a support structure, such as may be used, in particular, to support a car or a counterweight in an elevator installation. The present invention also relates to an elevator installation comprising such a support unit.

BACKGROUND OF THE INVENTION

Elevator installations typically have at least an elevator car and a counterweight, which are arranged in an elevator shaft and can be moved in opposite directions from one another. The elevator car and the counterweight are then held or moved by means of one or more supporting means, e.g., in the form of cables or belts. The supporting means are for the most part connected with the ends thereof to a fixed structure within the elevator shaft, and travel about deflection rollers that are fastened as a part of a support unit to a support structure of the elevator car or the counterweight. The supporting means may be driven by a drive, e.g., in the form of an electric motor. The described arrangement with deflection rollers that are fastened as a part of a support unit to support structures of the car or of the counterweight results in block-and-tackle arrangements so that a force intended to act on the supporting means from the drive can be kept sufficiently low.

Examples of elevator installations and support units used therein are described, inter alia, in WO 2011/012504, CN 203682813, and CN 103787169.

SUMMARY OF THE INVENTION

There may arise, inter alia, a need for elevator installations and, in particular, a support unit to be provided therein that have improved operational safety. There may furthermore be a need for a support unit that is relatively easy to assemble, has a low weight, and/or is easy to mount or maintain.

According to one aspect of the present invention, a support unit for an elevator installation for fastening a deflection roller to a support structure that has two yoke beams and a bearing is proposed. The yoke beams are arranged parallel to one another and are to be fastened to the support structure. At least partial regions of the deflection roller are arranged in an intermediate space between the yoke beams. The deflection roller is mounted by means of the aforementioned bearing so as to be able to rotate in relation to the yoke beams. The yoke beams, the deflection roller, and the bearing are adapted to transmit a support force, acting on the deflection roller due to the supporting means, to the support structure in an upwardly-oriented support direction, in order to support or move a weight that is fastened to the support structure against the force of gravity. The support unit is characterized in that at least two restraint devices are furthermore provided on the support unit, each of the restraint devices being fastened to the yoke beams and protruding into the intermediate space between the yoke beams in such a manner as to form a stop for if the bearing fails, in order to prevent the deflection roller from moving in the support direction due to the supporting force.

Possible features and advantages of embodiments of the present invention may be considered, inter alia, to be depending on the ideas and findings described hereinbelow.

Internal risk analyses conducted by the inventors have shown that the operational safety of an elevator installation can be significantly increased if—in the event that, for example, a bearing of a deflection roller to a support unit fails—it is ensured that the deflection roller cannot come free from the rest of the support unit.

It is therefore proposed to provide additional restraint devices to the yoke beams of the support unit. The restraint devices should be designed with respect to the positioning thereof and with respect to the mechanical load-bearing capacity thereof to the greatest extent possible so as to protrude into the intermediate space between the yoke beams—in which the deflection roller is also arranged—in such a manner as to retain the deflection roller against the yoke beams, for example, in the event that the deflection roller comes free from the bearing thereof.

In this manner, the deflection roller may thus be prevented from being able to come free from the rest of the roller fastening, i.e., in particular, from the yoke beams fastened to the support structure due to, for example, a support force applied thereto by the supporting means. A counterweight retained at the support structure can thus be prevented from crashing due to an additional protection brought about by the restraint device.

Preferably, the restraint devices and the fastening thereof to the yoke beams are adapted so as to prevent the deflection roller from moving in the support direction due to a support force of up to 250 kN, preferably between 20 and 210 kN. In other words, the restraint devices should be designed suitably with respect to the mechanical load-bearing capacity thereof so as to be able to withstand, in the event of the failure of the bearing, the forces typically occurring in an elevator installation that act on a deflection roller and are normally absorbed by the mounting thereof. In other words, the restraint devices should be sufficiently stable to hold the deflection roller and prevent same from coming lose from the support unit in the event that the deflection roller is no longer held by the bearing.

The restraint devices are then preferably fastened directly to the yoke beams. For example, the restraint devices may engage with holes or recesses provided in the yoke beams. This makes it possible to cause the considerable forces occurring, for example, if the bearing is damaged, which are then applied by the deflection roller on the restraint devices, to be routed directly to the yoke beams, which are generally mechanically stable.

The restraint devices may then be configured as relatively simple components, such as, for example, bolt-shaped pins. For example, such bolt-shaped pins in the form of screws, bolts, cotters, or the like may be fastened to the yoke beams. A material and material thickness may be selected as suitable in order to achieve the required load-bearing capacities of the restraint devices. For example, the restraint devices may be composed of metal, in particular, steel or high-strength alloys. Typical material thicknesses may be in the range of 0.2 cm to 10 cm, preferably 0.5 cm to 3 cm.

According to one embodiment, the restraint devices are respectively fastened to both opposite yoke beams and each completely span the intermediate space between the yoke beams. In other words, ends of, for example, bolt-shaped restraint devices are respectively fastened to one of the yoke beams so as to support and hold the respective restraint device at both ends.

According to one embodiment, the restraint devices are arranged above the bearing in the support direction. In other words, the restraint devices may be mounted onto the yoke beams at a position towards which the deflection roller moves in the event that it is no longer held by the bearing thereof. If the bearing fails, the deflection roller may thus move slightly towards the restraint devices and is then prevented thereby from moving further and thus from coming free from the support unit. The restraint devices are then loaded with pressure primarily by the deflection roller.

In one specific embodiment, the deflection roller is at least approximately cylindrical and has a diameter D. The restraint devices should then protrude a distance d, with respect to a direction parallel to the diameter D, into the intermediate space, the distance d being smaller than the diameter D, i.e., $d<D$. In other words, the restraint devices may be arranged, for example, above the bearing of the deflection roller in the support direction, i.e., there where a chord through the deflection roller in a direction parallel to the yoke beams is smaller than the diameter of the deflection roller. The restraint devices may be arranged there relatively close to an outer periphery of the deflection roller so that the distance d thereof from one another in the direction parallel to the yoke beams is smaller than the diameter D of the deflection roller. For example, the distance d may be between 2% and 80%, preferably between 5% and 50%, and more strongly preferably between 10% and 30% smaller than the diameter D of the deflection roller.

If the deflection roller should, for example, come free from the bearing thereof, the acting forces thus cause it to move slightly in the upwardly-oriented support direction, but then it is retained by the restraint devices and more or less clamped therebetween. Due to the greater diameter D thereof, the deflection roller is then unable to move through between the restraint devices separated by the narrow distance, and is thus held at the yoke beams.

According to one embodiment, the bearing is arranged below the yoke beams. In principle, it is possible for both the restraint devices and the bearing of the deflection roller to be fastened directly to the yoke beams. However, in the aforementioned embodiment, in which the restraint devices are to be arranged sufficiently above the bearing, this may necessitate that the yoke beams have a relatively large height in the support direction. In general, though, the yoke beams are preferably dimensioned so as to, on the one hand, meet load-bearing capacity requirements, e.g., for use within an elevator installation, but, on the other hand, not lead to unnecessary costs due to unnecessary use of materials, e.g., in the form of excessively wide or high yoke beams. In order to be able to sufficiently space the bearing of the deflection roller apart from the restraint devices, which—for stability reasons—are to be provided directly in the yoke beams, it may therefore be advantageous to arrange the bearing of the deflection roller below the yoke beams. The bearing may then be connected only indirectly, i.e., for example, via additional intermediate elements, to the yoke beams and held thereto.

For example, a downwardly-extending bearing retainer may be mounted at each of the yoke beams, and bearers forming the bearing may each be fastened to one of the bearing retainers. The bearing retainers may be provided, for example, in the shape of sheets or profiles, which extend adjacent to both end faces of the deflection roller and are fastened, for example, at one edge to the yoke beams. The bearers may be held, for example, in recesses in the bearing retainers. Alternatively, the bearers may be fastened, for example, by means of suitable fastening devices to the bearing retainers.

It shall be noted that some of the possible features and advantages of the present invention are described herein with reference to different embodiments, in particular, with reference to a support unit or with reference to an elevator installation using such a support unit. A person skilled in the art shall recognize that the features may be combined, adapted, or exchanged as appropriate in order to yield other embodiments of the present invention.

BRIEF DESCRIPTION OF THE DRAWINGS

Embodiments of the present invention shall be described hereinbelow, with reference to the accompanying drawings, wherein neither the drawings nor the description are to be interpreted as limiting the present invention.

The drawings are only schematic, and are not true to scale. Like reference signs refer in different drawings to like or analogous features.

DESCRIPTION OF EMBODIMENTS OF THE INVENTION

Figure 1:
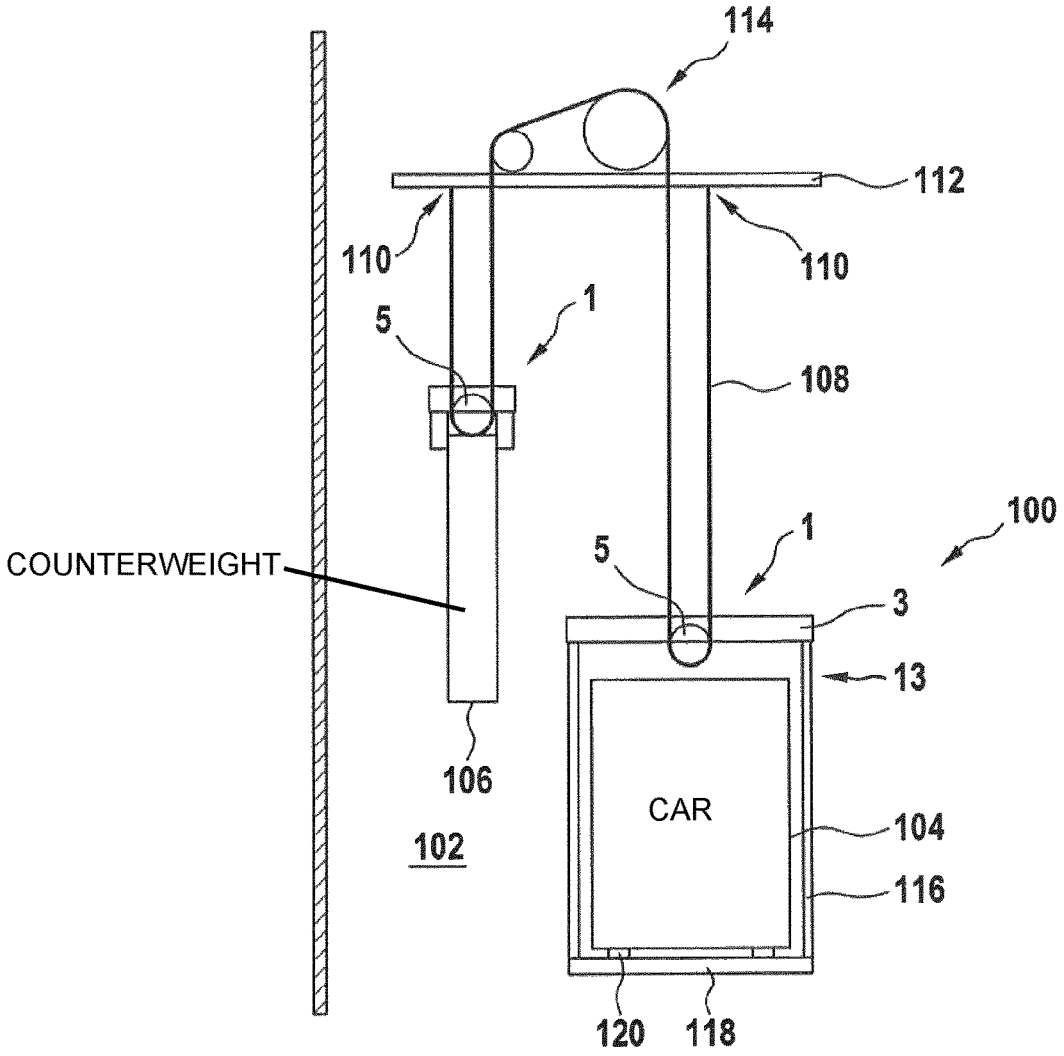
FIG. 1 illustrates basic principles of an elevator installation.

FIG. 1 illustrates a rough schematic view of an elevator installation 100. An elevator car 104 and a counterweight 106 are arranged in an elevator shaft 102. The elevator car 104 and the counterweight 106 are coupled to one another via a supporting means 108 in the form of one or more belts or cables. Ends 110 of the supporting means 108 are each connected to a support structure 112 fixedly installed in the elevator shaft 102. Also provided on the support structure 112 is a drive unit 114 having drive pulleys driven by an electric motor.

A deflection roller 5 is provided both to the elevator car 104 and to the counterweight 106. The deflection rollers 5 are each part of a support unit 1 and are mechanically connected therethrough to the elevator car 104/to the counterweight 106 by means of a support structure 13. The support structure 13 of the elevator car 104 has side shields 116 that are fastened at the upper ends thereof to beams 3 of the support unit 1. A lower yoke 118 that supports the elevator car 104 via abutments 120 is fastened to lower ends of the side shields 116.

The support means 108 spans from one end 110 fastened to the support structure 112, coming downward first and then about the deflection roller 5 of the counterweight 106, to then be returned upward to the drive unit 114, where it travels over the drive pulleys thereof. Thereafter, the support means 108 then spans further downward to the deflection roller 5 on the elevator car 104 and thereabout, to finally run back upward to the support structure 112, where it is fastened with the opposite end 110.

Figure 2:
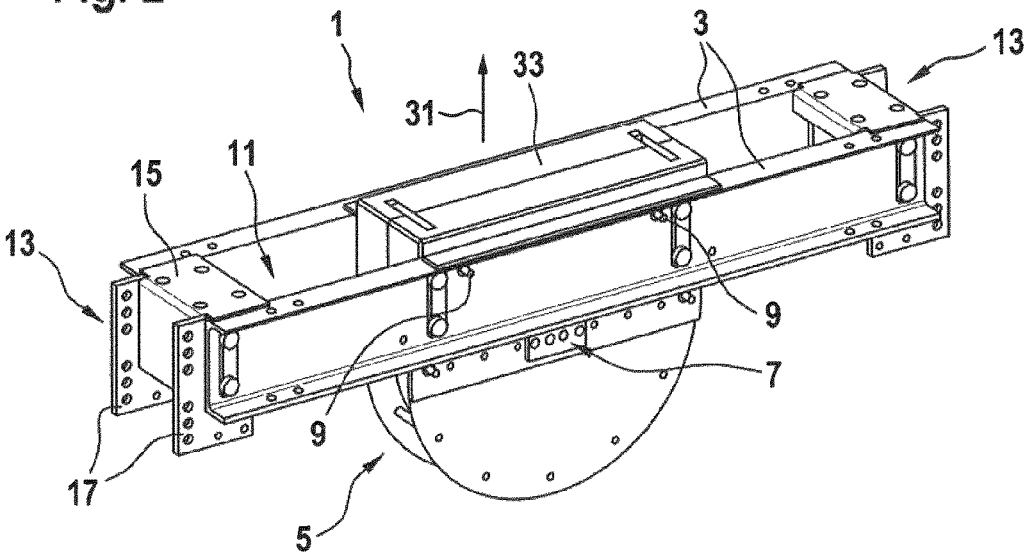
FIG. 2 illustrates a perspective view of a support unit according to one embodiment of the present invention.
Figure 3:
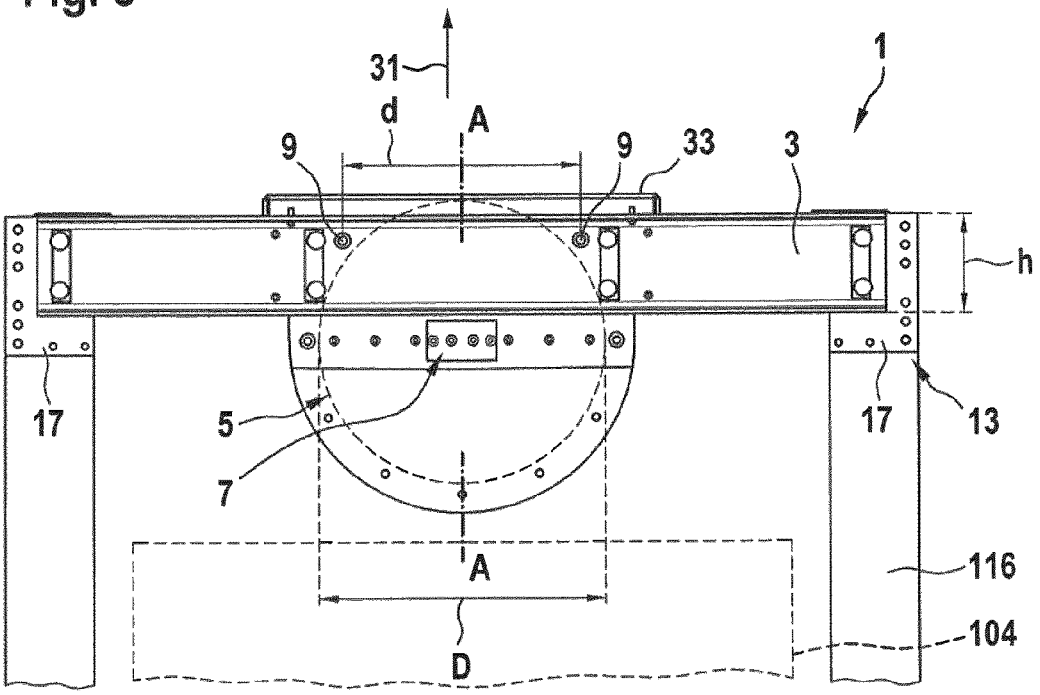
FIG. 3 illustrates a side view of the support unit from FIG. 2.
Figure 4:
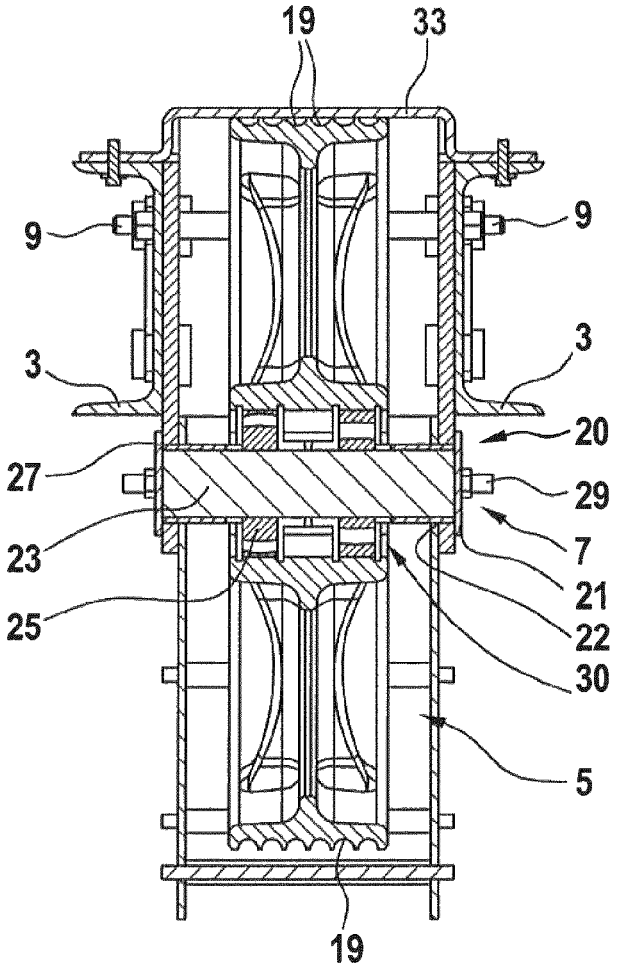
FIG. 4 illustrates a sectional view through the support unit from FIG. 2 along the line A-A.

FIGS. 2, 3, and 4 depict—respectively—a perspective view, side view, and sectional view along the line A-A- of FIG. 3 of a support unit 1 for an elevator car according to one embodiment of the present invention. The support unit described hereinbelow could also in principle be assigned to a counterweight.

The support unit 1 has two yoke beams 3, a deflection roller 5, and a bearing 7. The yoke beams 3 are each composed of an elongated steel section that has a U-shaped cross-section. The dimensions of this steel section are selected in accordance with the loads to be supported thereby. For example, the yoke beams 3 may have a height h in the range of 10 to 30 cm. A material thickness of the steel section used for the yoke beams 3 may exhibit much more than 2 mm, preferably more than 5 mm. The two yoke beams 3 are arranged parallel to one another, so that an intermediate space 11 is formed therebetween. A gap between the two yoke beams 3 and thus a width of the intermediate space 11 may be, for example, in the range of 5 to 50 cm, preferably 10 to 20 cm, so that at least partial regions of the deflection roller 5 can be accommodated in this intermediate space 11.

Provided at opposite ends of the yoke beams 3 are a plurality of metal sheets 15, 17 that are part of a support structure 13 with the help of which the support unit 1 and, in particular, the yoke beams 3 thereof can be fastened, for example, to an elevator car 104 or a counterweight 106.

The deflection roller 5 is fastened as a part of the support unit 1 via the bearing 7 to the yoke beams 3. The deflection roller 5 has a cylindrical shape, wherein a diameter D of the deflection roller 5 is generally greater than an axial length. Grooves 19 are provided on an outer surface of the deflection roller 5. The supporting means 108 can run through parts of this outer surface, wherein the grooves 19 can contribute to correct guidance of the supporting means 108 on the deflection roller 5 and, for example, preventing slipping thereof out of place in the axial direction.

The bearing 7, via which the deflection roller 5 is held onto the rest of the support unit 1, is arranged below the yoke beams 3 in the embodiment depicted. Retaining plates 21, which run adjacent to end surfaces of the deflection roller 5, are stably fastened to the yoke beams 3, and form a bearing retainer 20, then extend from the yoke beams 3. In the retaining plates 21, a recess 22 within which an axle 23 is engagedly retained is respectively provided at mutually opposite positions relative to the deflection roller 5 accommodated therebetween. The axle 23 is secured in relation to the retaining plates 21 with the aid of fastening plates 27 and one or more screws 29. The deflection roller 5 is mounted via cylinder roller bearings 25 so as to be able to rotate on the axle 23. Together, the axle 23 and the cylinder roller bearings 25 form bearings 30 that are fastened to the yoke beams 3 so as to spaced apart downwardly via the bearing retainer 20. It shall be readily understood that ball bearings or other roller bearings could also be used instead of cylinder roller bearings. Even sliding bearings would be conceivable. The axle 23 then extends substantially perpendicular to a longitudinal extension direction of the yoke beams 3, so that the deflection roller 5 is mounted so as to be able to rotate in the intermediate space 11 between the yoke beams 3 via the bearing 7.

The yoke beams 3, the deflection roller 5, and the bearing 7 are cooperatively adapted so that a support force acting on the deflection roller 5 due to the supporting means 108 can ultimately be transmitted to the support structure 13. The support force then acts in an upwardly oriented support direction 31 and may typically with elevator installations take values of several kN. The support force corresponds then to a counterforce that is required in order to, for example, move a weight of the elevator car 104 fastened to the support structure 13 against the force of gravity. Forces, such as the aforementioned support force, are then transmitted within the support unit 1 from the supporting means 108 surrounding the deflection roller 5 ultimately towards the support structure 13, due to sufficient dimensions of all of the supporting components, i.e., in particular, the yoke beams 3, the deflection roller 5, and the components 20 to 30 forming the bearing 7.

A cover plate 33 provided above the deflection roller 5 has substantially no supporting function, but instead serves solely to protect the lower-lying deflection roller 5 against influences coming from above.

In order to also protect the deflection roller 5, for example, in the event of failure of the bearing 7 from coming free from the rest of the support unit 1, in particular, the yoke beams 3, additional restraint devices 9 are provided at the support unit 1.

The restraint devices 9 are each provided in the form of bolt-shaped pins or screws that are each fastened to the yoke beams 3 and protrude into the intermediate space 11. In the example depicted, the restraint devices 9 are then configured as continuous pins that are fastened at one end to one of the yoke beams 3 and at an opposite end to the other of the yoke beams 3, and span the intermediate space 11 completely therebetween.

The restraint devices 9 are then arranged in an upper region of the yoke beams and spaced apart from one another in the longitudinal direction of the yoke beams 3 by a distance d from one another. The mounting of the deflection roller 5 via the bearing 7 well below the restraint devices 9 makes it possible for the deflection roller—shown only with dashed lines in FIG. 3—to be accommodated with an upper partial region longitudinally between the two restraint devices 9 and thus to rotate freely.

A diameter D of the deflection roller 5 is substantially greater than the distance d between the restraint devices 9 in a direction along the yoke beams 3, i.e., D>>d. For example, D may be >1.2*d.

For the case where the bearing 7, for example, fails and no longer holds the deflection roller 5, the deflection roller 5 can slip only slightly upward, i.e., in the direction of the support direction 31, before the restraint devices 9 form a stop and the deflection roller 5 thus runs with the outer periphery or outer surface thereof into the restraint devices 9 protruding into the intermediate space 11.

The restraint devices 9 are then designed with respect to the material selected therefor, dimensions thereof, and fastening thereof to the yoke beams 3 so as to be able to withstand forces of multiple kN brought about by the abutting deflection roller 5. A screw that serves as a restraint device 9, reaches from one of the yoke beams 3 through to the opposite yoke beam 3, and is anchored there or a corresponding other bolt-shaped pin may, for this purpose, be composed, for example, of a high-strength metal such as, for example, steel, and have diameter of, for example, more than 10 mm that ensures sufficient mechanical strength.

Figure 5:
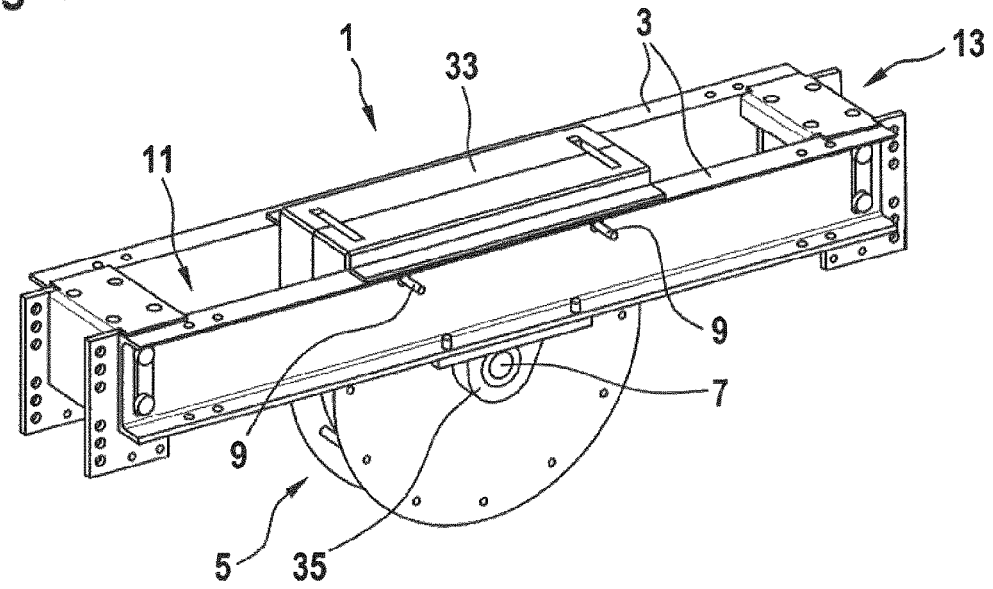
FIG. 5 illustrates a perspective view of a support unit according to another embodiment of the present invention.
Figure 6:
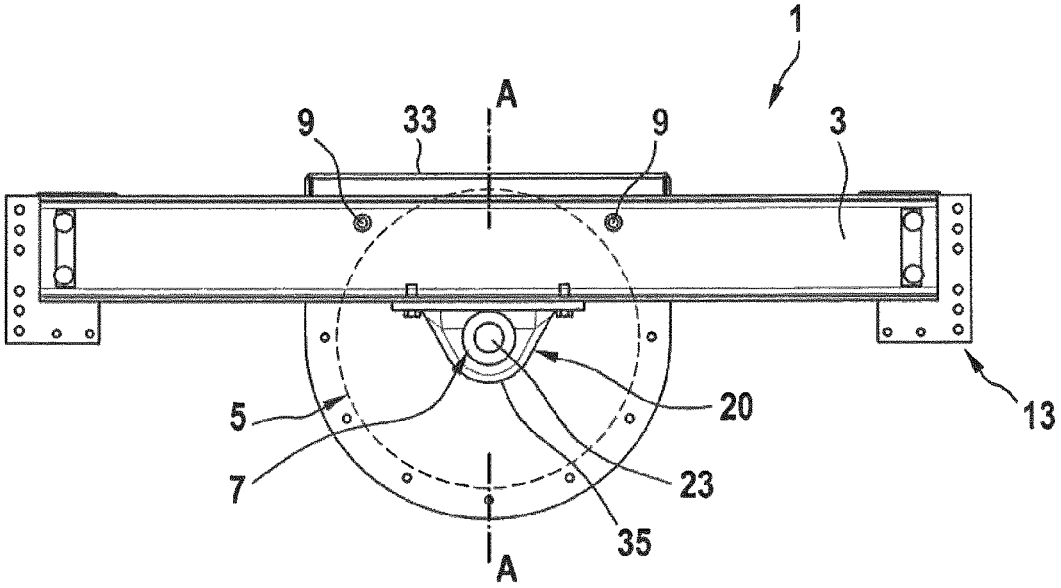
FIG. 6 illustrates a side view of the support unit from FIG. 5.
Figure 7:
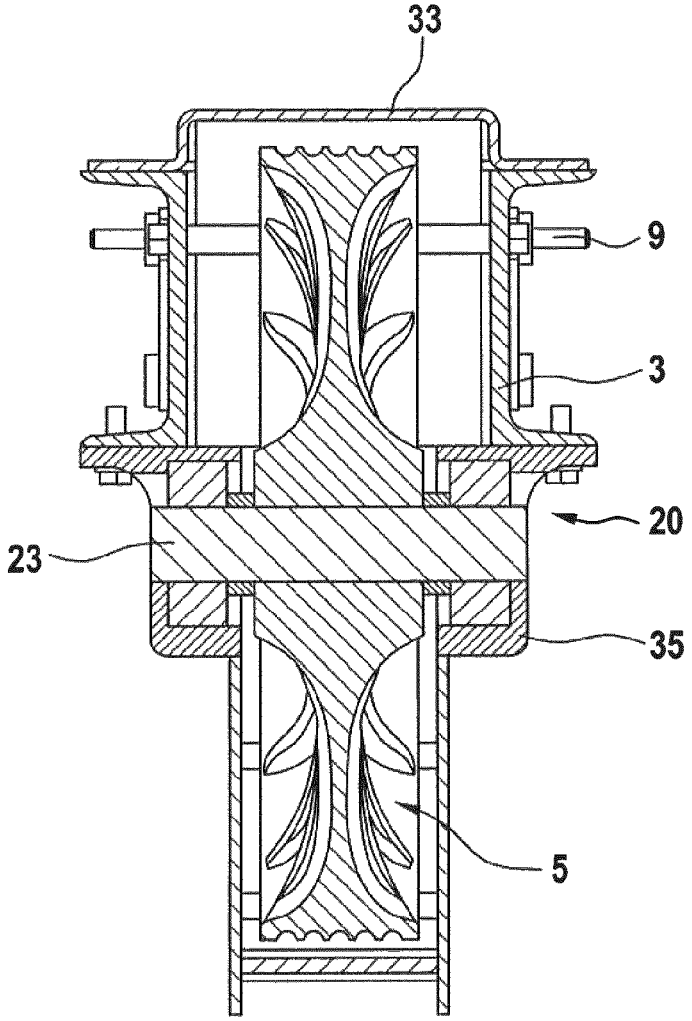
FIG. 7 illustrates a sectional view through the support unit from FIG. 5 along the line A-A.

FIGS. 5, 6, and 7 depict—respectively—a perspective view, side view, and sectional view along the line A-A of FIG. 6 of an alternative embodiment of a support unit 1. In the embodiment according to FIG. 4, the bearing has a roller bearing 25 that is formed by way of example by a cylinder roller bearing and is integrated into the deflection roller assembly in such a manner that the axle 23 is stationary. In the second embodiment (see, in particular, FIG. 7), however, the axle 23 rotates. The roller body of the deflection roller 5 is fixedly connected to the axle 23.

The axle 23 is rotatably connected to the upper yoke, composed of the two yoke beams 3, via the bearing 30 that is formed of a roller cylinder bearing. The support unit 1 is designed in terms of essential features analogously to the previously-described support unit of the embodiment depicted with respect to FIGS. 2 to 4. Only a type of the bearing 7 for the deflection roller 5 is designed differently. The bearing 7 has two flanges 35. Each flange 35 forms a bearing retainer 20 for the bearing 30. The flange 35 is fastened to a lower side of one of the yoke beams 3, and holds, via the bearing 30, an axle with which the deflection roller 5 can rotate. Via the flange 35, the bearing 7 of the support unit 1 is—similarly to with the previously described embodiment—held with a downward offset in relation to restraint devices 9 provided on the yoke beams 3. Accordingly, the deflection roller 5 can, in turn, be held at least with a partial region within the intermediate space 11, and, in the longitudinal direction, between the restraint devices 9 arranged at a distance from one another. The restraint devices 9 can thus, in the event of a failure of the bearing 7, prevent the deflection roller 5 from coming free upward from the yoke beams 3.

Embodiments of the support unit 1 described herein enable, for example, an elevator installation 100 to have enhanced safety during operation. The arrangement of the restraint devices 9 so as to directly engage with the yoke beams 3 makes it possible to keep the amount of material used low and provide a space-saving solution for a support unit 1, for example, for a support structure serving as part of an elevator installation 100.

Finally, it should be noted that terms such as "comprising" and the like do not preclude other elements or steps, and terms such as "a" or "one" do not preclude a plurality. Furthermore, it should be noted that features that have been described with reference to one of the above embodiments may also be used in combination with other features of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A support unit for an elevator installation for fastening a deflection roller to a support structure, comprising:

two yoke beams wherein the yoke beams are arranged parallel to one another and are adapted to be fastened to the support structure;

a bearing;

wherein at least partial regions of the deflection roller are arranged in an intermediate space between the yoke beams;

wherein the deflection roller is mounted by the bearing to rotate in relation to the yoke beams;

wherein the yoke beams, the deflection roller, and the bearing are adapted to transmit a support force, acting on the deflection roller due to a supporting means, to the support structure in an upwardly-oriented support direction to support or move a weight that is fastened to the support structure against a force of gravity; and at least two restraint devices are provided on the support unit, each of the restraint devices being fastened to the yoke beams and protruding into the intermediate space between the yoke beams to form a stop wherein, if the bearing fails, prevents the deflection roller from moving in the support direction due to the support force.

2. The support unit according to claim 1 wherein the restraint devices prevent the deflection roller from moving in the support direction due to the support force of up to 250 kN.

3. The support unit according to claim 1 wherein the restraint devices are configured as bolt-shaped pins.

4. The support unit according to claim 1 wherein the restraint devices are each fastened to both of the yoke beams and each of the restraint devices completely spans the intermediate space between the yoke beams.

5. The support unit according to claim 1 wherein the restraint devices are arranged above the bearing in the support direction.

6. The support unit according to claim 1 wherein the deflection roller has a diameter and wherein the restraint devices protrude, relative to a direction parallel to the diameter, a distance into the intermediate space that is smaller than the diameter.

7. The support unit according to claim 1 wherein the bearing is arranged below the yoke beams.

8. The support unit according to claim 1 including a downwardly-extending bearing retainer mounted on each of the yoke beams and wherein another bearing forming a part of the bearing is fastened to the bearing restraints.

9. An elevator installation having at least one of the support unit according to claim 1 attached to an elevator car or a counterweight.

* * * * *